US009206682B2

(12) United States Patent
Püttmann et al.

(10) Patent No.: US 9,206,682 B2
(45) Date of Patent: Dec. 8, 2015

(54) BORING ELEMENT FOR A GROUND BORING DEVICE

(75) Inventors: Franz-Josef Püttmann, Lennestadt (DE); Peter Grass, Lennestadt (DE); Gerhard Völkel, Erndtebruck (DE); Andreas Riekes, Schmallenberg (DE); Frank Prutti, Lennestadt (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 751 days.

(21) Appl. No.: 13/499,422

(22) PCT Filed: Sep. 24, 2010

(86) PCT No.: PCT/EP2010/005850

§ 371 (c)(1),
(2), (4) Date: Jun. 6, 2012

(87) PCT Pub. No.: WO2011/038866

PCT Pub. Date: Apr. 7, 2011

(65) Prior Publication Data

US 2012/0273274 A1 Nov. 1, 2012

(30) Foreign Application Priority Data

Oct. 1, 2009 (DE) ..... 10 2009 043 716

(51) Int. Cl.
*E21B 47/01* (2012.01)
*E21B 7/04* (2006.01)

(52) U.S. Cl.
CPC ..... *E21B 47/011* (2013.01); *E21B 7/046* (2013.01)

(58) Field of Classification Search
CPC ..... E21B 47/011; E21B 7/046
USPC ..... 175/45, 50, 61, 62, 293
See application file for complete search history.

(56) References Cited

U.S. PATENT DOCUMENTS

| | | | | |
|---|---|---|---|---|
| 4,673,033 | A * | 6/1987 | Minear et al. | 166/55.1 |
| 5,526,886 | A | 6/1996 | Jenne | |
| 5,795,991 | A | 8/1998 | Hesse et al. | |
| 5,896,937 | A * | 4/1999 | Kaneko | 173/211 |
| 7,270,197 | B2 | 9/2007 | Püttmann | |

FOREIGN PATENT DOCUMENTS

| | | | |
|---|---|---|---|
| DE | 195 34 806 | A1 | 2/1997 |
| DE | 198 23 629 | A1 | 9/1999 |
| DE | 199 10 292 | A1 | 3/2000 |
| DE | 199 47 645 | C1 | 3/2001 |
| EP | 0 361 805 | A1 | 4/1990 |
| EP | 0 617 193 | A1 | 9/1994 |
| EP | 0 759 498 | A2 | 2/1997 |
| WO | WO 02/35049 | A1 | 5/2002 |

* cited by examiner

*Primary Examiner* — Nicole Coy
*Assistant Examiner* — Kristyn Hall
(74) *Attorney, Agent, or Firm* — Howard IP Law Group, PC

(57) ABSTRACT

A boring element of a ground boring device includes a housing having a receptacle, a transmitter arranged in the receptacle of the housing and supported in the receptacle for movement in a longitudinal-axial direction of the boring element, and a front buffer connecting the transmitter with the housing. The transmitter moves towards a rear in the receptacle as a result of a deformation of the front buffer, when a rear percussive impulse is applied to the boring element, without the transmitter coming directly into contact with another part of the boring element.

10 Claims, 2 Drawing Sheets

BORING ELEMENT FOR A GROUND BORING DEVICE

CROSS-REFERENCES TO RELATED APPLICATIONS

This application is the U.S. National Stage of International Application No. PCT/EP2010/1005850, filed Sep. 24, 2010, which designated the United States and has been published as International Publication No. WO 2011/038866 and which claims the priority of German Patent Application, Serial No. 10 2009 043 716.9, filed Oct. 1, 2009, pursuant to 35 U.S.C. 119(a)-(d).

BACKGROUND OF THE INVENTION

The invention relates to a boring element of the ground boring device with a housing and a transmitter arranged in a receptacle of the housing.

It is known to provide ground boring devices with a transmitter for localizing the signals transmitted by the transmitter with a receiving unit arranged above ground to thereby determine the position of the ground boring device in the ground. The course of the borehole can then be continuously monitored and corrected—if this is a steerable ground boring device—in the event of a deviation from the desired course by rerouting the ground boring device.

Various embodiments of ground boring devices are known in the art. Frequently, so-called earth rockets are used to create horizontal boreholes in the ground, i.e. boreholes which extend essentially in the ground near the surface in the horizontal direction. These are self-propelled percussion boring devices which are equipped with a percussion drive operating with compressed air, with the required compressed drive air being supplied via a rear supply hose. The earth rocket may be steered, for example, by adjusting the tip of the drill head, which causes a lateral deflection leading to an arcuate course of the borehole. A steerable earth rocket of this type is disclosed, for example, in DE 199 47 645 C1.

Also known are horizontal boring devices where a drill head arranged at the front end of a drill pipe is advanced through the ground by pushing and rotating the drill head with a drive device located in a pit, in a trench or on the surface. The horizontal boring device of this type can be steered by constructing the drill head asymmetrically, for example with an sloped font face, so that a lateral force is generated when the drill head is advanced only by pushing, i.e. without rotation, causing the desired lateral deflection of the drill head. This lateral force is compensated on the average for a straight borehole by additionally driving the drill head with a uniform rotation.

Also in such horizontal boring device based on a drill pipe, the advance of the drill head may be supported by applying percussions. This may be accomplished —as with the earth rocket—by an internal percussion drive; however, in most cases the percussions are generated by an external percussion drive and transmitted to the drill head via the drill pipe. This obviates the need to integrate a percussion drive into the drill head which frequently has limited dimensions.

The drill head for such horizontal boring device based on drill pipes is disclosed, for example, in DE 195 34 806 A1. The drill head includes a sloped a drill head referred to as steering head and a connected housing having a receptacle for a transmitter. The housing has on its end opposing the sloped drill head an exterior thread configured to screw the housing into a first pipe section of the drill pipe. The transmitter is supported inside the receptacle of the cylindrical housing for movement along its longitudinal-axial direction, with each end of the transmitter contacting a respective buffer in order to dampen the relative movement of the transmitter inside the receptacle of the housing caused by the percussions acting on the drill pipe. The magnitude of the force impulses applied to the transmitter can thereby be reduced significantly, which is necessary because this transmitter is typically a sensitive electronic component.

An integration of a transmitter in an earth rocket of similar construction is disclosed, for example, in DE 198 23 629 A1, which proposes to retrofit an earth rocket with a drill head adapter in which the transmitter is integrated. The ends of the transmitter are hereby embedded in the corresponding receptacle in the boring tool of the drill head adapter between two damping elements.

It has been observed in conventional ground boring devices with integrated transmitter that the stress on the transmitter caused by percussions cannot always be sufficiently reduced, thus resulting in damage caused by the operation of the percussion ground boring device.

Based on this state of the art, it was therefore the object of the invention to provide an improved integration of a transmitter in a ground boring device.

SUMMARY OF THE INVENTION

According to the core of the invention, the magnitude of the forces transmitted from a housing of the ground boring device, in which the transmitter is integrated, to the transmitter are reduced further by suspending the transmitter for elastic damping exclusively in a pulling fashion. The transmitter is hereby connected with the housing inside a receptacle of the housing of a boring element of a ground boring device, in which the transmitter is movably supported in the longitudinal-axial direction (of the boring element), by way of a front buffer such that the transmitter experiences a rearward displacement in the receptacle enabled by a deformation of the buffer, when a rear percussion is applied on the boring element, without the transmitter directly striking an element of the boring element.

It has been determined that damping of the percussion impulses can be improved compared to the conventional two-sided embedding in two damping elements by suspending the transmitter in the housing of the boring element in an exclusively pulling, elastically damping fashion.

A "boring element" of a ground boring device may be any component of a ground boring device in which a transmitter can be integrated.

A "buffer" refers to a component which converts the kinetic energy of a connected component (in this case the transmitter) through deformation and thereby reduces the magnitude of the transmitted forces. According to the invention, a buffer may be constructed exclusively as a resilient element as well as exclusively as a damping element. Preferably, however, the buffer according to the invention is a combined resilient-damping element.

In the context of the invention, the term "front " or "forward" refers to a location disposed from the respective element in the direction of the front of the borehole and thus the front of the ground drilling device. Commensurately, "rear " or "rearward" refers to a direction extending from the front of the borehole or the front of the ground boring device towards the already produced borehole.

In a preferred embodiment of the boring element according to the invention, the boring element is constructed as a drill head. The transmitter, which is arranged in a receptacle of the housing of the drill element, is thereby arranged as far as possible near the front end of the ground boring device, thus potentially improving the positioning accuracy.

In another preferred embodiment of the boring element according to the invention, an additional rear buffer may be provided which is arranged such that the transmitter deforms this buffer only after a defined rearward displacement in the receptacle (which may be very small). The rear buffer may be employed, i.e. having a damping effect, when unexpectedly high percussion forces are applied on the boring element, which cause a corresponding large displacement of the transmitter in the receptacle.

The boring element according to the invention may additionally have a power supply for the transmitter integrated in the boring element. This may obviate the need for an electrically conducting connection of the transmitter to an external power supply. Such connection with an external power supply with conventional ground boring devices has frequently shown to be susceptive to faults. An integrated power supply for the transmitter may preferably be implemented with batteries; however, other possibilities for supplying energy are also feasible. For example, a turbine driven by a drilling fluid or by compressed air may be connected to a generator which produces the necessary energy for operating the transmitter.

Advantageously, the receptacle in the housing of the boring element may be accessible from the outside, so that the transmitter and optionally also the power supply can be inserted and exchanged again without the need to dismantle the ground boring device itself. The opening in the housing of the boring element required for the accessibility may preferably be closable with a closure element. Preferably, the closure element may be easily secured and again released, thus simplifying maintenance work on the transmitter and the preferably integrated power supply.

In a particularly preferred embodiment, the receptacle may be formed as a front borehole in the boring element. This may obviate the need for introducing an opening in the casing of the boring element.

Preferably, when employing a front borehole for the receptacle of the transmitter, a closure plug may be provided as closure element, which furthermore is preferably clampingly held in the borehole. This may be accomplished, for example, with a conical closure plug which is in turn held in a corresponding conical receptacle of the borehole. The reactive forces from the ground acting on the closure plug during the drilling operation then press on the closure plug so as to press the closure plug into the borehole and support the clamping attachment of the closure plug in the borehole.

In another preferred embodiment, at least the closure element, the buffer and the transmitter may be connected with one another so that they can be inserted in and removed from the boring element as a transmitter assembly. This significantly simplifies the installation and uninstallation of the transmitter assembly for maintenance. When an integrated power supply and/or a rear buffer are provided, these can also be integrated in the transmitter assembly.

BRIEF DESCRIPTION OF THE DRAWING

The invention will now be described in more detail with reference to exemplary embodiments illustrated in the drawings.

The drawings show in.

DETAILED DESCRIPTION OF PREFERRED EMBODIMENTS

Figure 1:
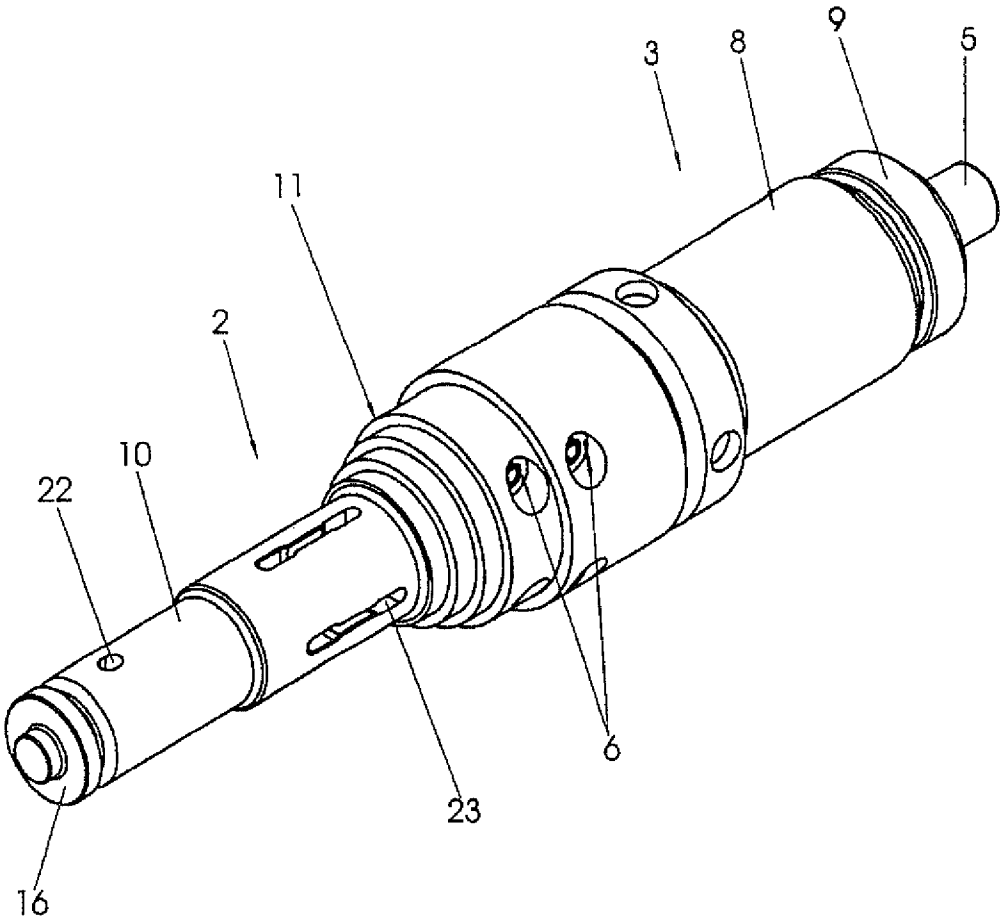
FIG. 1 a drill head according to the invention in an isometric view.
Figure 2:
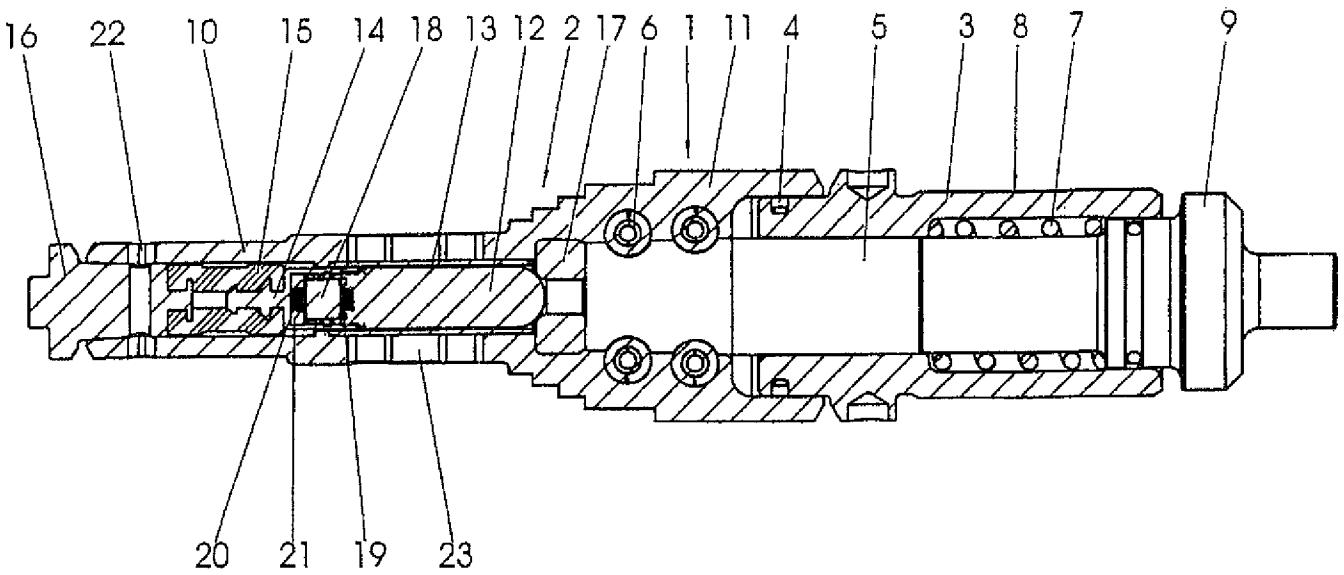
FIG. 2 the drill head of FIG. 1 in a cross-sectional side view.

FIGS. 1 and 2 show a first embodiment of a drill head according to the invention. This drill head is intended for use as a component of an earth rocket and is configured to be screwed into a housing of the earth rocket (not illustrated).

The drill head includes a cylindrical housing 1 constructed in two parts, wherein the two housing parts can move with respect to one another over a specified distance in a longitudinal-axial direction. A front housing part 2 is movably supported on a rear housing part 3, wherein the support is sealed by a sealing ring 4. A piston 5, which is connected with a total of four transverse bolts 6 which can be inserted through corresponding openings in the housing, extends through the rear housing part 3 and a section of the front housing part 2. The piston 5 is supported inside the rear housing part 3 for displacement in the longitudinal-axial direction, wherein the rear housing part 3 and the piston 5 support each other via a cylindrical coil spring 7.

The rear housing part also includes an exterior thread 8, with which the drill head can be screwed into a corresponding interior thread of the earth rocket housing.

When the drill head is installed, the free end of the piston 5 projects into a percussion space of the earth rocket, in which a percussion piston which is driven in a conventional manner by compressed air is driven in a cyclical back-and-forth motion. The forward stroke of the percussion piston is braked and terminated when the percussion piston strikes the free end of the piston 5 and accelerates the piston 5 in a forward direction. This acceleration of the piston 5 is directly transferred to the front housing part 2 of the drill head, allowing the drill head to stepwise create the borehole. After a defined forward movement of the piston 5, the piston strikes with a ring-shaped shoulder 9 a rear end of the second housing part 3, causing the remaining kinetic energy of the piston 5 to also be transferred to the second housing part 3 of the drill head and the connected earth rocket housing. The earth rocket housing is then drawn in, after the front housing part 2 of the drill head has advanced the borehole.

The front housing part 2 of the drill head is constructed of a first section referred to as a reaming rod 10 having a substantially uniform outside diameter. Connected thereto is a stepped conical expansion section 11 which is used to expand the borehole predrilled by the reaming rod 10 to the desired diameter. The reaming rod 10 is hollow and thus forms a receptacle for a transmitter 12 which can be used to localize the drill head with a receiving device (not illustrated) positioned above ground. The transmitter 12 which also has a cylindrical shape is typically supported in the receptacle for displacement in the longitudinal-axial direction (of the drill head and the transmitter 12), for which purpose a guide sleeve 13 is integrated in the reaming rod 10. The material of the reaming rod 10 is selected so as to, on one hand, shield the signals transmitted by the transmitter 12 either not at all or only insignificantly and, on the other hand, have only a small coefficient of friction with the material of the transmitter 12. The transmitter 12 is connected with a front buffer 15 by way of a fixing sleeve 14 which is also movably supported in a section of the receptacle inside the reaming rod 10. The end of the buffer 15 facing the fixing sleeve 14 is connected with a closure stopper 16 which closes the front opening of the reaming rod 10.

The percussion forces transmitted from the percussion piston of the earth rocket to the piston 5, and therefrom to the front housing part 2 of the drill head and therefrom to the closure plug 16 are further transmitted via the front buffer 16 and the fixing sleeve 14 to the transmitter 12, with the percussion forces operating on the transmitter 12 as pulling forces; the transmitter 12 is therefore suspended in a pulling fashion. The magnitude of these pulling forces is reduced due to the deformation of the front buffer 15 under the effect of the forward-acting percussion forces and the inertia forces of the transmitter 12, thereby converting the pulling forces partially into potential forces and heat. This can prevent force peaks which may cause damage to the transmitter 12.

The drill head according to the invention furthermore includes a rear buffer 17 which is arranged in a defined, albeit very small distance from the rear end of the transmitter 12 when no load is applied to the drill head. When percussion forces act on the piston 5 of the drill head, the transmitter 12 is first displaced relative in the guide sleeve 13 due to a deformation of the front buffer 15, without resulting in an additional damping deformation of the rear buffer 17. The rear buffer 17 is used to additionally dampen the relative movement of the transmitter 12 in the guide sleeve 13 under particularly high percussion forces.

A battery 18 used as an internal power supply for the transmitter is additionally disposed inside the fixing sleeve 14. The battery 18 is supported, on one hand, via a first cylindrical coil spring 19 on the transmitter 12 and, on the other hand,—also via a second cylindrical coil spring 20 and an additional battery buffer 21—on the fixing sleeve 14 which is made of an electrically conducting material. The cylindrical coil springs 19, 20 operate as additional buffer elements and also as contact elements forming an electrical circuit including the electrically conducting fixing sleeve 14.

The closure plug 16, the front buffer 15, the fixing sleeve 14 and the transmitter 12 are connected with one another so that they can be inserted as a transmitter assembly into the receptacle of the reaming rod 10 through the front opening and also be removed therefrom. The power supply integrated between the fixing sleeve 14 and the transmitter 12 also forms a component of the transmitter assembly.

The closure plug 16 is formed with a conically tapered section (in the installed state facing towards the rear), in which a corresponding conically expanding section of the receptacle of the reaming rod is inserted. This connection between the closure plug 16 and the reaming rod 10 establishes a clamping connection between these two elements, which is strengthened by the resistance forces of the ground operating on the front side of the closure plug 16. This prevents accidental release of the closure plug 16 and the elements of the transmitter assembly connected thereto. Accidental release of the closure plug (e.g., during handing before insertion into the ground) can also be prevented by an (unillustrated) dowel pin which is inserted in a transverse borehole 22 extending through the closure plug 16 and the front section of the reaming rod 10. The closure plug 16 can be released with a tool engaging in the groove formed between the closure plug 16 and the ring-shaped end face of the reaming rod 10.

The reaming rod has a total of four longitudinal openings 23 in the region of the transmitter, which are filled with a plastic material. The plastic material is characterized in that it attenuates the signals emitted by the transmitter not at all or only weakly. This plastic filler prevents clogging of the longitudinal openings 23 in the ground.

What is claimed is:

1. A boring element of a ground boring device, comprising:

a housing having a receptacle, a transmitter having first and second ends arranged in the receptacle of the housing and supported in the receptacle for movement in a longitudinal-axial direction of the boring element, and a front buffer connecting the first end of the transmitter with the housing, and a rear buffer arranged at a defined non-zero distance from the second end of the transmitter at least when the transmitter is biased toward the front buffer, wherein the rear buffer is deformed only after a defined rearward movement of the transmitter in the receptacle.

2. The boring element of claim 1, wherein the boring element is constructed as a drill head.

3. The boring element of claim 1, further comprising a power supply integrated in the boring element for supplying electric power to the transmitter.

4. The boring element of claim 1, wherein the receptacle is accessible from outside and further comprising a closure element for closing the receptacle.

5. The boring element of claim 4, wherein the receptacle is formed as a front borehole in the boring element.

6. The boring element of claim 5, wherein the closure element is constructed as a closure plug which is clampingly held in the front borehole.

7. The boring element of claim 4, wherein at least the closure element, the front buffer and the transmitter are connected with one another.

8. The boring element of claim 7, further comprising a sleeve arranged between and connecting the transmitter and the front buffer.

9. The boring element of claim 1, further comprising a guide sleeve arranged in the boring element and in contact with a side wall of the transmitter to support and permit movement of the transmitter in the longitudinal-axial direction.

10. The boring element of claim 1, wherein the rear buffer is arranged at a second defined non-zero distance from the second end of the transmitter when no force is placed on the transmitter in the longitudinal-axial direction.

* * * * *